US009396678B2

(12) United States Patent
Hong

(10) Patent No.: US 9,396,678 B2
(45) Date of Patent: Jul. 19, 2016

(54) ORGANIC LIGHT EMITTING DIODE DISPLAY DEVICE AND METHOD FOR COMPENSATING FOR LUMINANCE VARIATIONS THEREOF

(71) Applicant: LG Display Co., Ltd., Seoul (KR)

(72) Inventor: Moo-Kyoung Hong, Jinhae-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/551,568

(22) Filed: Nov. 24, 2014

(65) Prior Publication Data

US 2015/0154912 A1 Jun. 4, 2015

(30) Foreign Application Priority Data

Nov. 29, 2013 (KR) ..... 10-2013-0147442

(51) Int. Cl.
*G09G 3/32* (2016.01)

(52) U.S. Cl.
CPC ..... *G09G 3/3225* (2013.01); *G09G 2320/029* (2013.01); *G09G 2320/0233* (2013.01); *G09G 2320/0271* (2013.01); *G09G 2320/0285* (2013.01); *G09G 2320/0693* (2013.01)

(58) Field of Classification Search
CPC ..... G09G 3/3291; G09G 2320/0233; G09G 2330/12; G09G 2300/0819; G09G 2320/0646
USPC ..... 345/211
See application file for complete search history.

(56) References Cited

U.S. PATENT DOCUMENTS

2011/0285763 A1* 11/2011 Bassi ..... G06T 5/008 345/694
2015/0103062 A1* 4/2015 Kwon ..... G09G 3/3291 345/212

* cited by examiner

*Primary Examiner* — Ariel Balaoing
(74) *Attorney, Agent, or Firm* — Fenwick & West LLP

(57) ABSTRACT

An organic light emitting diode display device includes: a display panel including a plurality of pixels in a display region, each pixel including a switching thin film transistor, a driving thin film transistor, and a light emitting diode, the display region divided into a plurality of regions; a diode current measuring portion electrically connected to the light emitting diode of each pixel and measuring a current of each divided region; a timing control portion obtaining a gain value of each divided region based on the measured current of each divided region, and generating compensated image data using the gain value; a gate driver supplying gate voltages to the display panel; and a data driver supplying data voltages corresponding to the compensated image data to the display panel.

6 Claims, 4 Drawing Sheets

ORGANIC LIGHT EMITTING DIODE DISPLAY DEVICE AND METHOD FOR COMPENSATING FOR LUMINANCE VARIATIONS THEREOF

CROSS-REFERENCE TO RELATED APPLICATION

This application claims the benefit of Korean Patent Application No. 10-2013-0147442, filed on Nov. 29, 2013, which is hereby incorporated by reference for all purposes as if fully set forth herein.

BACKGROUND OF THE INVENTION

1. Field of the Invention

The present disclosure relates to an organic light emitting diode display device having a structure to compensate for a luminance variation and a method of compensating for a luminance variation.

2. Discussion of the Related Art

An organic light emitting diode (OLED) display device emits light directly from each element formed on a substrate in a different way from a liquid crystal display device, and thus the OLED display device has advantages of high response speed and high contrast ratio.

However, an OLED display panel suffers from low luminance uniformity due to variation of elements, such as thin film transistors and organic emitting layers, forming the OLED display panel.

Accordingly, a step of measuring a luminance property of each region for the same color pattern using a luminance meter and adjusting a luminance to display uniform luminance is required for the OLED display panel. Thus, a manufacturing time may be extended.

To solve this problem, a process to raise uniformity of organic material deposition, a process to reduce sheet resistances among an anode, an organic material and a cathode, and a process to form thin film transistors having stable variation may be improved. However, even though the processes are improved, a light-emission luminance property of the organic material varies over time, and thus OLED display panels have different luminance properties. Thus, the test step for luminance adjustment may be needed.

SUMMARY OF THE INVENTION

Accordingly, the present invention is directed to an organic light emitting diode display device having a structure to compensate for a luminance variation and a method of compensating for a luminance variation that substantially obviates limitations and disadvantages of the related art.

Advantages of the present invention includes providing an organic light emitting diode display device having a structure to compensate for a luminance variation and a method of compensating for a luminance variation that can reduce process time for luminance compensation.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages in accordance with the purpose of the present invention, as embodied and broadly described herein, an organic light emitting diode display device includes: a display panel including a plurality of pixels in a display region, each pixel including a switching thin film transistor, a driving thin film transistor, and a light emitting diode, the display region divided into a plurality of regions; a diode current measuring portion electrically connected to the light emitting diode of each pixel and measuring a current of each divided region; a timing control portion obtaining a gain value of each divided region based on the measured current of each divided region, and generating compensated image data using the gain value; a gate driver supplying gate voltages to the display panel; and a data driver supplying data voltages corresponding to the compensated image data to the display panel.

In another aspect, a method of compensating for a luminance variation of an organic light emitting diode display device, wherein the organic light emitting diode display device includes a display panel including a plurality of pixels in a display region, each pixel including a switching thin film transistor, a driving thin film transistor, and a light emitting diode, the display region divided into first to Nth regions, the method includes: measuring a current of a nth region among the first to Nth regions through a diode current measuring portion; obtaining a gain value based on the measured current of the nth region; and adjusting image data signals using the gain value.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to exemplary embodiments, examples of which are illustrated in the accompanying drawings. The same reference numbers may be used throughout the drawings to refer to the same or like parts.

Figure 1:
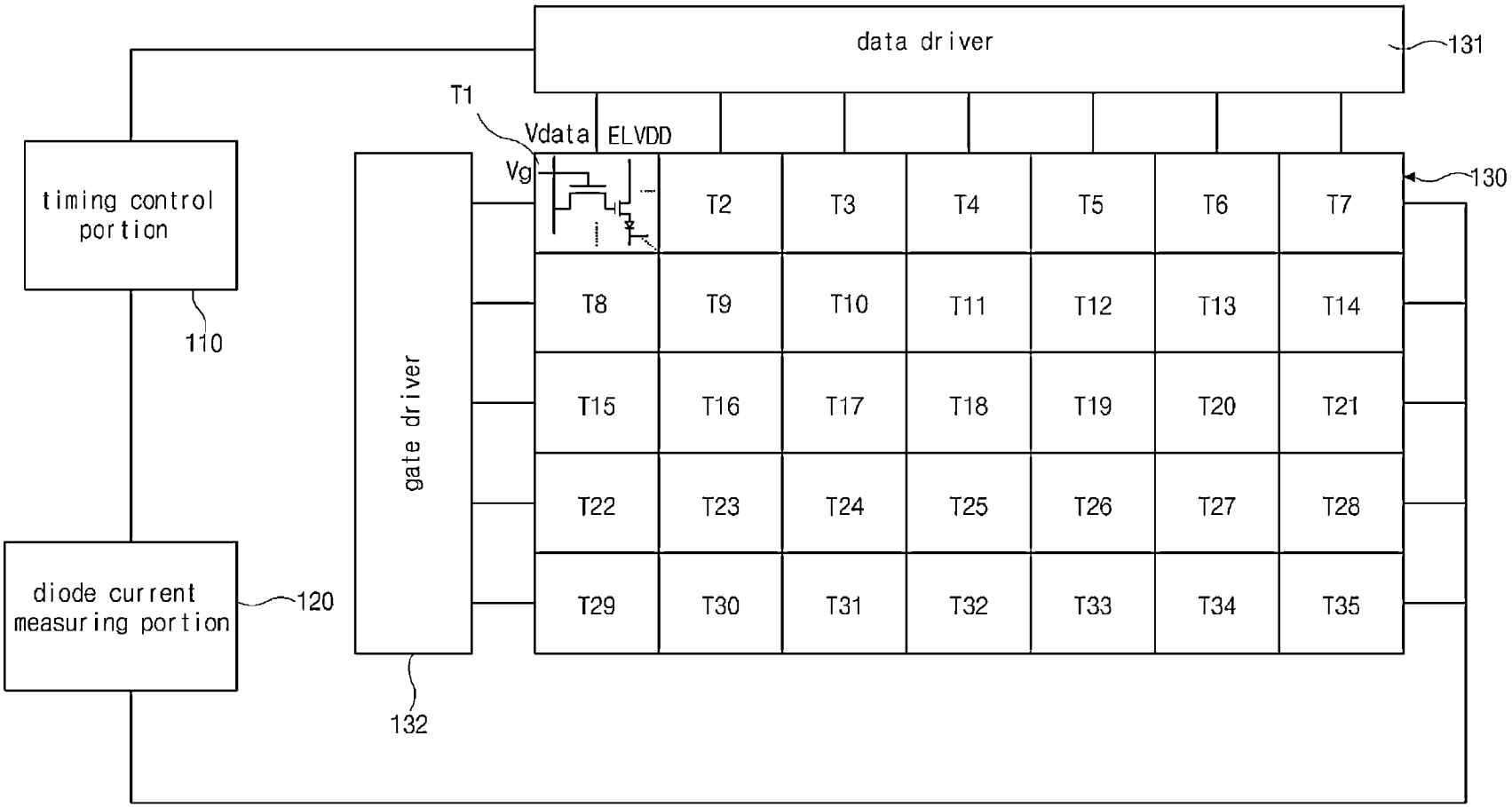
FIG. 1 is a block diagram illustrating an OLED display device according to an embodiment of the present invention.

FIG. 1 is a block diagram illustrating an OLED display device according to an embodiment of the present invention.

Referring to FIG. 1, the OLED display device includes a timing control portion 110, a diode current measuring portion 120, a data driver 131, a gate driver 132, and an OLED display panel 130.

The OLED display panel 130 is supplied with voltages from the data driver 131 and the gate driver 132, and displays images. The OLED display panel 130 includes a switching thin film transistor, a driving thin film transistor, and a light emitting diode connected to the driving thin film transistor formed on a substrate. The light emitting diode includes an anode and a cathode. A power line is electrically connected to the driving thin film transistor.

The timing control portion 110 supplies signals to display images to the data driver 131 and the gate driver 132. The timing control portion 110 is connected to the diode current measuring portion 120 and measures a current applied to each region of the OLED display panel 130.

Regarding measuring the current applied, the timing control portion 110 may divide a display region of the OLED display panel 130 into a plurality of regions, where each region has a predetermined size. A number of the divided regions may increase or decrease according to an initial setting. As a number of the divided regions increases, more precise luminance compensation is possible.

In the embodiment, for the purpose of explanations, it is assumed that the OLED display panel 130 has a resolution of, for example, but is not limited to, 1920 columns and 1080 rows, and is divided into 7-column regions and 5-row regions in a matrix form i.e., 35 regions T1 to T35.

The diode current measuring portion 120 functions to measure a current of the light emitting diode in the OLED display. To do this, the diode current measuring portion 120 may be connected to the cathode or a source electrode of a driving thin film transistor.

The data driver 131 and the gate driver 132 are operated by the signals from the timing control portion 110, then the gate driver 132 outputs gate voltages Vg to gate lines corresponding to areas to be measured, and the data driver 131 outputs data voltages Vdata to data lines corresponding to areas to be measured. Further, power voltages ELVDD are output to power lines connected to the pixel regions.

The timing control portion 110 may have a storing portion to store a value of the measured current.

The above-configured OLED display device can have a luminance, which is obtained based on the current measured by the diode current measuring portion 120, very similar to a luminance measured actually by a luminance meter. This is explained below with reference to FIGS. 2 and 3.

Figure 2:
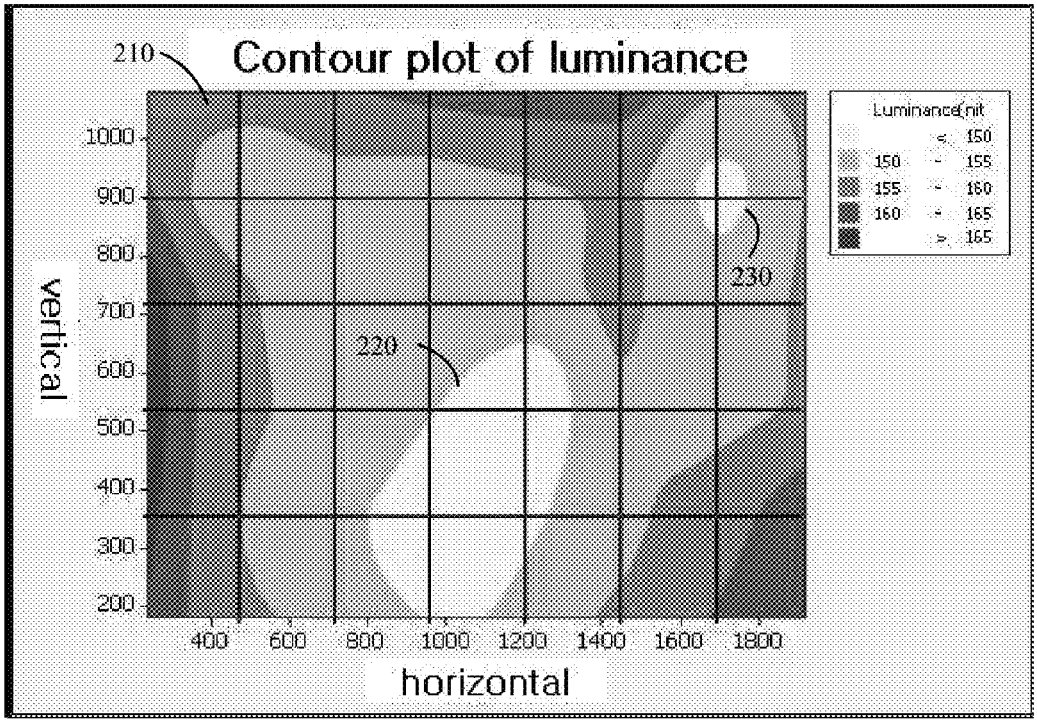
FIG. 2 RELATED ART
FIG. 2 is a contour plot of luminance showing a result through a luminance measuring method using a luminance meter according to the related art.
Figure 3:
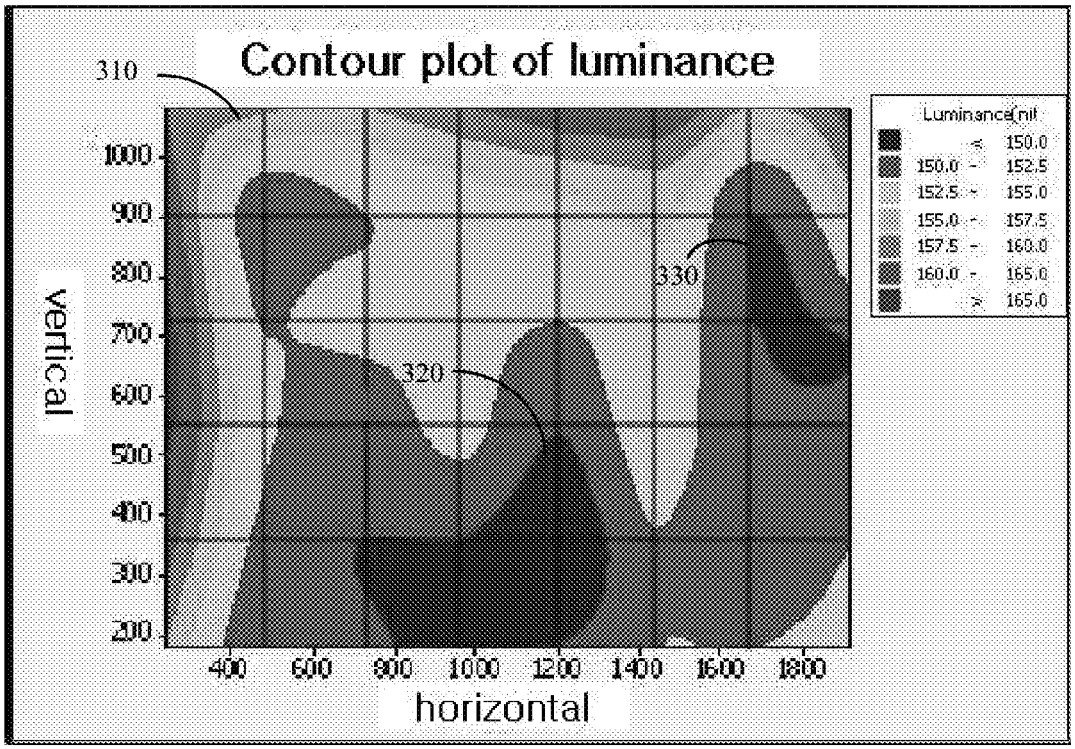
FIG. 3 is a contour plot of luminance showing a result through a current measuring method according to the embodiment of the present invention.

FIG. 2 is a contour plot of luminance showing a result through a luminance measuring method using a luminance meter according to the related art, and FIG. 3 is a contour plot of luminance showing a result through a current measuring method according to the embodiment of the present invention.

The contour plots of luminance of FIGS. 2 and 3 are obtained with respect to an OLED display panel having a resolution of 1920*1080.

The contour plot of luminance of FIG. 3 is made by obtaining a luminance proportional to a measured current. Overall, luminance of FIG. 3 is quite similar to that of FIG. 2. A luminance measuring unit of FIG. 2 is 5 nit while a luminance unit of FIG. 3 is 2.5 nit.

This shows that the difference between the result of the luminance obtained by the current measuring method of the embodiment and the result of the luminance obtained by the actual luminance measuring method is small. For example, shapes and locations of contours 210, 220, and 230 of FIG. 2 obtained by the luminance meter are similar to shapes and locations of contours 310, 320, and 330 of FIG. 3 obtained by the current measuring method, respectively.

Since the related art uses the luminance measuring method using an expensive luminance meter, production cost increases and a luminance measuring time is extended.

However, the embodiment uses the current measuring method to obtain the result very similar to the result obtained by the related art. Therefore, the embodiment has advantage that a luminance measuring time is shortened and production cost is reduced by eschewing using the expensive luminance meter.

The contour plot of luminance of FIG. 3 can be used for luminance compensation of the OLED display panel, which is explained below with reference to FIG. 4.

Figure 4:
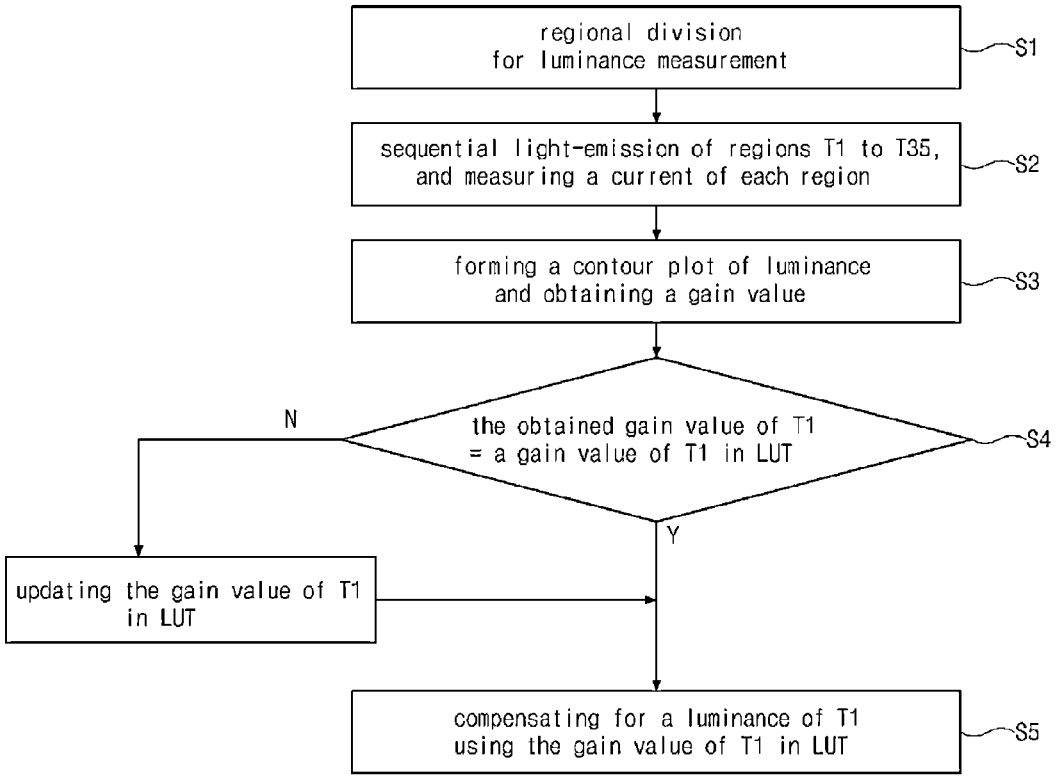
FIG. 4 is an algorithm illustrating a method of compensating for a luminance variation of the OLED display device according to the embodiment of the present invention.

FIG. 4 is an algorithm illustrating a method of compensating for a luminance variation of the OLED display device according to the embodiment of the present invention.

Referring to FIG. 4, the OLED display device performs a luminance compensation through first to fifth steps S1 to S5.

In the first step S1, a regional division for luminance measurement is performed. For example, as shown in FIG. 1, the region division divides the display region of the OLED display panel into 35 regions T1 to T35 on 7 columns and 5 rows.

To measure the first region T1, the data driver 131 applies data voltages to the first region T1 and the gate driver 132 applies gate voltages to the first region T1.

In this case, the data voltages output from the data driver 131 may have a maximum grey level.

For the diode current measuring portion 120 to measure a current of a nth region Tn, the diode current measuring portion 120 is connected to the cathode of each pixel of the nth region Tn. Alternatively, the diode current measuring portion 120 may be connected to the cathode of each pixel of the nth region Tn via a separate circuit installed in the OLED display panel 130.

In the second step S2, the first to thirty-fifth regions T1 to T35 sequentially emit light, and a current of each region is measured by the diode current measuring portion 120.

For example, the data driver 131 and the gate driver 132 apply voltages to the first region T1 to emit light from the first region T1, and then a current of the first region T1 is measured by the diode current measuring portion 120.

Likewise, other regions T2 to T35 are then sequentially operated to emit light, and each current of a corresponding region is measured by the diode current measuring portion 120.

The measured currents of the regions T1 to T35 may be stored in the storing portion of the OLED display device.

In the third step S3, a contour plot of luminance is formed based on the measured currents, and then a gain value for each region is obtained based on the contour plot of luminance.

The contour plot of luminance is obtained based on the currents measured by the diode current measuring portion 120 electrically connected to the cathodes of the first to thirty-fifth regions T1 to T35, and the measured currents of the first to thirty-fifth regions T1 to T35 may be converted into the gain values, respectively.

The method of converting the current value of the first region T1 into the gain value of the first region T1 is explained as follows:

(1) a maximum value is obtained from amongst the current values of the first to thirty-fifth regions T1 to T35;

(2) the current value of the first region T1 is divided by the maximum value to obtain an intermediate result value; and (3) a reciprocal of the intermediate result value is generated as a gain value.

Assuming that the measured current value of the first region T1 is 0.3165 A, and the maximum among the current values of the first to thirty-fifth regions T1 to T35 is 0.9357 A, the intermediate result value of the first region T1 is 0.3382.

Accordingly, the gain value of the first region T1 is the reciprocal of 0.3382 i.e., 2.9568. This gain value is stored.

Likewise, the gain values of the second to thirty-fifth regions T2 to T35 can be obtained.

In the fourth step S4, the obtained gain value of the first region T1 is compared with a gain value stored in a look-up table (LUT).

When the obtained gain value is the same as the gain value stored in the LUT or within an error range, a luminance of the first region T1 is compensated for by using the obtained gain value. In this case, the gain value of the first region T1 stored in the LUT does not change and is maintained.

When the obtained gain value is beyond an error range, the obtained gain value is stored as the gain value of the first region T1 in the LUT and a luminance of the first region T1 is compensated for by using the obtained gain value. In this case, the gain value of the first region T1 in the LUT is updated with the obtained gain value.

The above fourth step S4 may be performed by the timing control portion 110.

In the fifth step S5, luminance of region T1 is compensated for by adjusting image data of the first region T1 using the gain value stored of the first region T1 in the LUT. This compensation is conducted by the timing control portion 110.

The gain value of the first region T1 stored in the LUT is for luminance compensation of the first region T1.

To compensate for the luminance of the first region T1 using the corresponding gain value, the image data corresponding to the first region T1 is multiplied by the gain value. Accordingly, compensated data voltages corresponding to the compensated/adjusted image data are output to the OLED display panel 130 from the data driver 131.

The above fourth and fifth steps S4 and S5 can be also conducted to compensate for luminance variation of other regions T2 to T35.

The above-described method can be applied to achieve luminance uniformity of each of red, green and blue of an OLED display panel including red, green and blue pixel units.

As described above, the embodiment can obtain and compensate for luminance variation through measuring currents of light emitting diodes of an OLED display panel. Accordingly, production cost can be reduced, and a luminance measuring time can be reduced. Thus, production efficiency can be improved.

Further, luminance compensation can be performed regardless of size and type of an OLED display panel because the compensation is based on the current measuring method.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting diode display device, comprising:

a display panel including a plurality of pixels in a display region, each pixel including a switching thin film transistor, a driving thin film transistor, and a light emitting diode, the display region divided into a plurality of regions;

a diode current measuring portion electrically connected to the light emitting diode of each pixel and measuring a current of each divided region to generate a contour plot of luminance based on the measured current;

a timing control portion obtaining a gain value of each divided region based on the measured current of each divided region, and generating compensated image data using the gain value to compensate for non-uniformity of luminance in the display region according to the contour plot of luminance generated based on the measured current;

a gate driver supplying gate voltages to the display panel; and a data driver supplying data voltages corresponding to the compensated image data to the display panel.

2. The device of claim 1, wherein the timing control portion includes a storing portion that stores the measured current by the diode current measuring portion.

3. The device of claim 2, wherein the timing control portion converts the measured current into the gain value and stores the gain value in the storing portion.

4. A method of compensating for a luminance variation of an organic light emitting diode display device, wherein the organic light emitting diode display device includes a display panel including a plurality of pixels in a display region, each pixel including a switching thin film transistor, a driving thin film transistor, and a light emitting diode, the display region divided into first to Nth regions, the method comprising:

measuring currents of the first to Nth regions through a diode current measuring portion;

generating a contour plot of luminance based on the measured currents of the first to Nth regions;

obtaining gain values based on the measured currents of the first to Nth regions, each of the gain values associated with a corresponding region of the first to Nth regions; and adjusting image data signals using the gain values to compensate for non-uniformity of luminance in the display region according to the contour plot of luminance generated based on the measured currents.

5. The method of claim 4, wherein obtaining the gain values comprises:

obtaining a maximum current among the currents of the first to Nth regions; and dividing, for each of the first to Nth regions, a measured current of a region by the maximum current to obtain an intermediate result value associated with the region, a gain value associated with the region being a reciprocal of the intermediate result value associated with the region.

6. The method of claim 4, wherein adjusting the image data signals using the gain values includes multiplying the image data signals by the gain values.

* * * * *